US005816776A

United States Patent [19]

Chambon et al.

[11] Patent Number: 5,816,776

[45] Date of Patent: Oct. 6, 1998

[54] LABYRINTH DISK WITH BUILT-IN STIFFENER FOR TURBOMACHINE ROTOR

[75] Inventors: Frédéric Chambon, Vaux Le Penil; Patrick Didier Michel Lestoille, Saint Maur; Jacques Henri Mouchel, Paris; Jean-Claude Taillant, Vaux Le Penil, all of France

[73] Assignee: Societe Nationale d'Etude et de Construction de Moteurs d'Aviation "Snecma", Paris, France

[21] Appl. No.: 791,051

[22] Filed: Jan. 28, 1997

[30] Foreign Application Priority Data

Feb. 8, 1996 [FR] France ..... 96 01527

[51] Int. Cl.[6] ..... F01D 11/02

[52] U.S. Cl. ..... 415/174.5; 415/174.4; 415/178; 415/180; 416/95; 416/220 R

[58] Field of Search ..... 415/174.5, 174.4, 415/173.7, 115, 116, 178, 180, 199.5; 416/198 A, 200 A, 201 R, 204 A, 220 R, 95

[56] References Cited

U.S. PATENT DOCUMENTS

| | | | |
|---|---|---|---|
| 3,832,090 | 8/1974 | Matto | 416/95 |
| 5,143,512 | 9/1992 | Corsmeier et al. | 415/115 |
| 5,173,024 | 12/1992 | Mouchel et al. | 416/220 R |
| 5,236,302 | 8/1993 | Weisgerber et al. . | |
| 5,275,534 | 1/1994 | Cameron et al. | 416/95 |
| 5,310,319 | 5/1994 | Grant et al. | 416/220 R |
| 5,333,993 | 8/1994 | Stueber et al. | 415/174.5 |
| 5,402,636 | 4/1995 | Mize et al. | 415/115 |

FOREIGN PATENT DOCUMENTS

| | | | |
|---|---|---|---|
| 0 272 966 | 6/1988 | European Pat. Off. . | |
| 0 463 955 | 1/1992 | European Pat. Off. . | |
| 0 541 250 | 5/1993 | European Pat. Off. . | |
| 610314 | 10/1948 | United Kingdom . | |
| 2244100 | 11/1991 | United Kingdom | 416/220 R |

*Primary Examiner*—Christopher Verdier
*Attorney, Agent, or Firm*—Oblon, Spivak, McClelland, Maier & Neustadt, P.C.

[57] ABSTRACT

A labyrinth disk includes a main stiffener placed in the middle of the rim immediately below labyrinth elements. Attachment elements are preferably in the form of a bayonet attachment system using teeth fixed on the labyrinth disk crown and teeth fixed on the rotor. Attachment by bolting may optionally be used. The disk may be utilized with turbojets, on the cooling circuit, on the upstream side of the high pressure turbine.

7 Claims, 5 Drawing Sheets

A

LABYRINTH DISK WITH BUILT-IN STIFFENER FOR TURBOMACHINE ROTOR

BACKGROUND OF THE INVENTION

1. Field of the Invention

The invention relates to turbomachines, such as turbojets with axial flow using labyrinth sealing devices to separate chambers containing air and/or oil. In particular, this is the case of the labyrinth fixed on the upstream side of the high pressure turbine.

2. Discussion of the Background

With reference to FIG. 1, the technological definition of turbomachines involving air flows at different pressures and temperatures, includes the use of sealing devices between chambers containing air and/or oil. This is the case of the labyrinth disk 2 that exists upstream from the high pressure turbine 1 and located on the passage of a part of the cold stream at the combustion chamber. In this position, this part is subjected to extremely high mechanical forces particularly due to the centrifugal force, since it is placed on the rotor. It is also in a difficult environment since the air stream surrounding it is fairly oxidizing and the temperature is very high. There are also very severe vibrational excitation phenomena that occur when passing through certain speeds, at which some parts of the rotary equipment become resonant.

For these reasons, this part which is also called the high pressure turbine front labyrinth, is one of the most difficult parts to design. Furthermore, this operation sometimes results in a part with insufficiently long life, or a limitation as to its thermal qualities.

FIG. 1 shows that this labyrinth disk 2 comprises several parts, including the labyrinth itself mostly facing the arrow indicated as 2. The lips of this labyrinth are supported by a rim 3 that projects upwards through a crown 4 which is supported on a downstream surface 5 of the rotor disk 8 to which this part is fixed. On many recent turbojets, it is fixed by bolts 6 passing through the inner part of this part, which terminates at an inner stiffener 7.

It should also be noted that this bolted attachment is not conducive to long life of this whole part.

The purpose of the invention is to optimize the shape of this part, namely the labyrinth disk and its attachment device to the high pressure turbine rotor disk 8.

SUMMARY OF THE INVENTION

Consequently, the main object of the invention is a labyrinth disk for a turbomachine rotor comprising:

a main rim, a labyrinth built into the rim, a crown in the outer extension of the rim, to be supported on an upstream surface of the rotor, and means of attachment of the labyrinth disk on the rotor.

According to the invention, the labyrinth disk comprises a main radial stiffener built into the rim, just on the inside of the labyrinth.

In one embodiment of the labyrinth disk according to the invention, the crown is an upper part of the rim relatively elongated in the radial direction, slightly complex, its downstream surface being in the same axial position as the downstream end of the main stiffener.

In a first embodiment, the attachment means comprise attachment bolts placed in attachment holes formed in the inner part of the rim, inside and upstream from the stiffener.

In another embodiment of the invention, the attachment means comprise attachment teeth designed to be placed behind the teeth fixed on the rotor in a bayonet locking system. In these cases, the crown may include stiffeners placed along the inner extension of the attachment teeth.

Axial stops may also be used with the system, acting as stops facing the rotor stop surfaces placed on an upstream surface of the rotor.

The crown of the labyrinth disk according to the invention may comprise stiffeners placed on the downstream surface of the rim.

Part of the downstream surface of the crown may then act as an axial stop surface, particularly when it has ribs.

Axial stops may also consist of the inner surface of attachment teeth.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
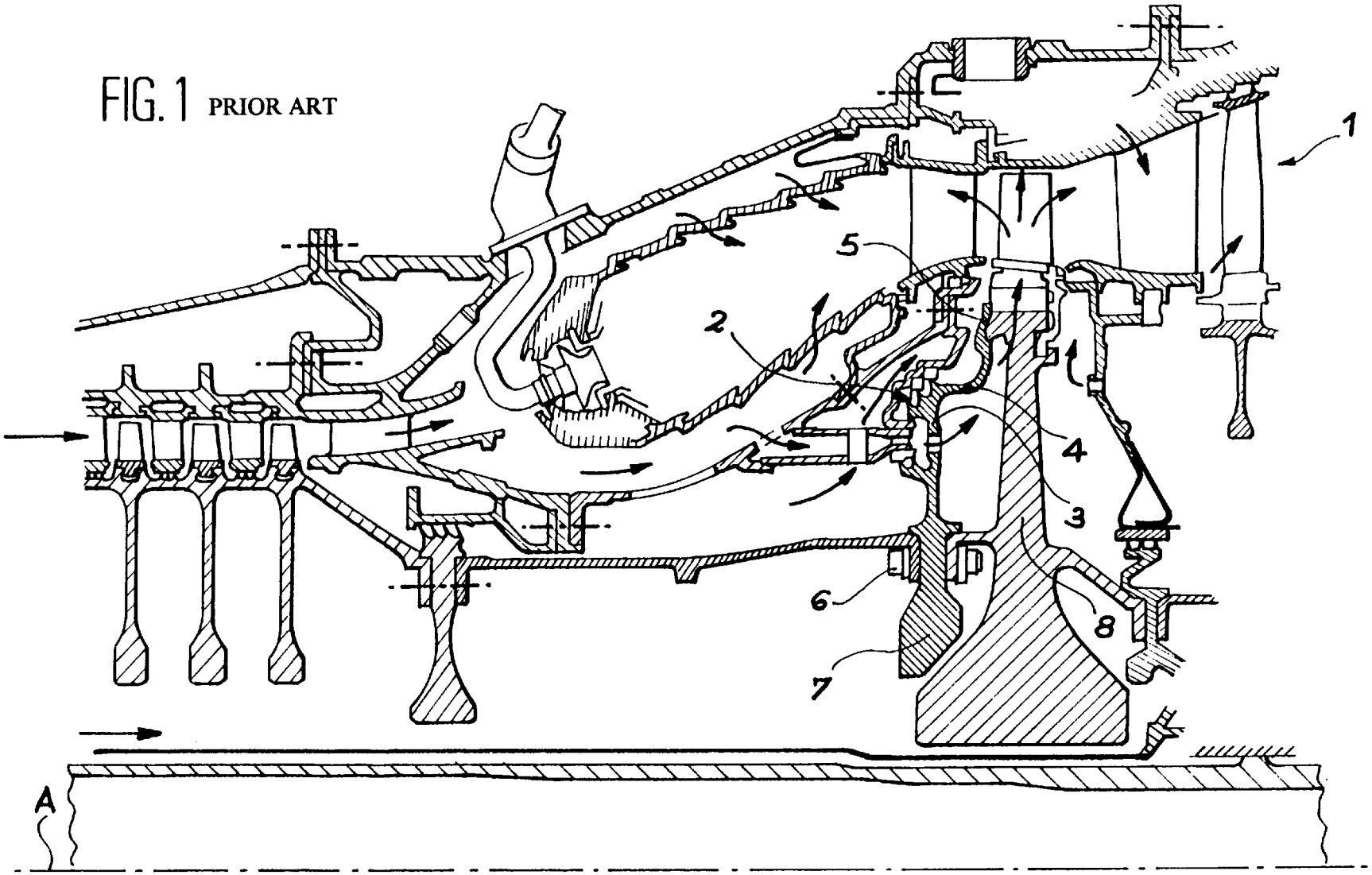
FIG. 1 PRIOR ART
FIG. 1, a longitudinal half-section of part of a turbojet according to prior art.

The labyrinth disk according to the invention is placed at approximately the same position as the labyrinth disk in FIG. 1.

It generally comprises a rim 13 that forms the radial structure of this part. The inner part of this rim 13 terminates in an inner stiffener 9 which is smaller than stiffener 7 in FIG. 1.

Labyrinth 10 in the labyrinth disk consists of two parts each comprising several lips that are tangential with friction parts 16 fixed on a fixed part 17 added onto the inside of the stator at the outlet from the combustion chamber 20.

In the embodiment shown in FIG. 1, the assembly is fixed onto the rotor, symbolized by the radial disk 8, by the inner part, i.e. the flange located above the inner bore. The attachment means shown are bolts 6 penetrating inside holes in the inner bore.

The rim 13 is extended by a central part comprising passages 11 and inner orifices 15 allowing the passage of the cooling air stream from the upstream part to the downstream part of the labyrinth disk.

The outer part of the labyrinth disk 12 according to the invention, consists of the crown 14 extending from the rim 13 to be supported by an outer end 18 on an upstream surface 19 of the rotor. This crown 14 is somewhat less convex than that shown in FIG. 1.

It is thus possible that the seal is made between the volume of the turbomachine placed inside the volume delimited by combustion chambers 20, and the inlet to the high pressure turbine 1 symbolized by a blade 21 in its first stage. However, passages 11 allow the cold stream to pass from the upstream surface of labyrinth disk 12 towards its downstream surface 22.

It can be seen that the inner stiffener 9 is smaller. However, a main stiffener 23 is provided in the middle of the labyrinth disk 12, i.e. on rim 13. It is shaped in the form of a torus that projects radially onto the downstream surface 22 of the labyrinth disk 12 immediately below the labyrinth lips 10 and below passages 11. Its downstream end is in the same longitudinal position as the downstream end of the downstream surface 22 of crown 14. Lower orifices 15 are also provided so that a relatively small amount of the cold air stream passing from upstream to downstream through the labyrinth disk can pass below and around this main stiffener 23, between it and the upstream surface 19 of the rotor disk 8. This type of cold air current can cool this main stiffener 23 and the downstream surface 22 of labyrinth disk 12. The two cool air flows passing through passages 11 and the inner orifices 15 join together behind labyrinth disk 10 on the downstream surface 22 of the crown 14 to rise between the attachment teeth 24. They thus cool the entire rear part of this assembly formed by the labyrinth disk. They reach the rim of the turbine disk 8 and join the blade 21 cooling circuits and the attachment compartments of these blades.

This main stiffener 23 provides most of the mechanical strength of the labyrinth disk 10. It contributes to reducing the size of the inner stiffener 9 and to reducing the general dimensions of the labyrinth disk 10 and particularly crown 14. It should be noted that the shape of the crown may be somewhat less convex but slightly offset towards the downstream side of labyrinth disk 12, to be almost tangential with the upstream surface 19 of the rotor disk 8.

The general flexibility of the rim 13 of labyrinth disk 12 is maintained by the fact that this main stiffener 23 is slightly offset towards the downstream direction. Since this main stiffener 23 is closer to the operational elements of the labyrinth disk 12, i.e. the labyrinths themselves 10, improves their mechanical strength. Furthermore, his main stiffener 23 increases the thermal response time of the labyrinth disk 12, since it is placed in the central part of this disk. It improves the compatibility of radial displacements of the labyrinth disk 12 with respect to turbine disk 8 and thus minimizes forces on the upper support means of labyrinth disk 12. These support means also contribute to the attachment of labyrinth disk 12 to the rotor.

In the outer part, these attachment means may indeed be composed of attachment teeth 24 placed on the downstream surface 22 of the labyrinth disk 12 and in particular, on the outer part of the crown 14. There attachment teeth 25 of a bayonet locking system, facing these teeth on the upstream surface 19 of the rotor disk 8; the number of these teeth is the same as the number of attachment teeth 24 on labyrinth disk 12. Thus, once in its radial and axial position, the labyrinth disk 12 may be rotated by half the pitch of the attachment teeth 24 and 25 to be fixed behind the attachment teeth 24 of the bayonet locking system.

The axial position of the labyrinth disk 12 is controlled with respect to the rotor disk 8, by the downstream surface 22 or rim 13 and crown 14. In the solution shown in FIG. 1, ribs 26 are placed on the downstream surface 22 of the crown 14, in order to stiffen it. They are supported on the downstream surface 22 of rotor disk 8, and thus form axial stops. It should be noted that the labyrinth disk 12 may be fixed by a system of bolts 6 in its inner part.

Radial stops 27 may be provided on the upstream surface 19 of the rotor disk 8, immediately below the bayonet attachment teeth 25, in order to be supported on the outer surface of the attachment teeth 24 of labyrinth disk 12. Radial stops 27 are only facing attachment teeth 24 when the part is in the locking position in the bayonet system.

No other attachment system is necessary in this embodiment. This thus prevents the possible need for an attachment hook on the downstream surface 22 of the rim 13 or the crown 14.

In this embodiment, some of the radial loads are absorbed by radial stops 27, a part being absorbed by the main stiffener 23 and a smaller part being taken on bolts 6.

Figure 3:
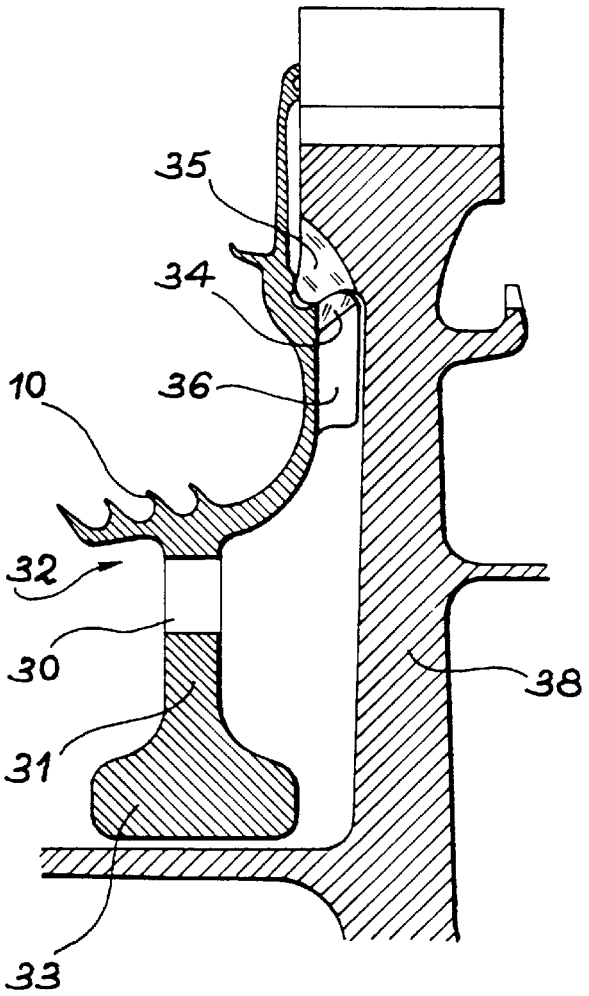
FIG. 3, a section of a first alternative of the labyrinth disk according to the invention.

FIG. 3 shows a first alternative of the labyrinth disk according to the invention. It shows the use of holes 30 placed on base 31 of the single main stiffener 33, which is consequently somewhat elongated, but is always located immediately below the labyrinth 10. Furthermore, the bayonet attachment system is only a single series of teeth 34 on the labyrinth disk 32, since they act as attachment teeth that fit behind the attachment teeth 35 of the rotor disk 38 bayonet locking system, and also act as radial stops, due to their inclined surface, cooperating with the corresponding inclined surfaces of the attachment teeth of rotor disk 38. These attachment teeth 34 of the labyrinth disk 32 are preferably housed in the upper part of ribs 36.

Figure 2:
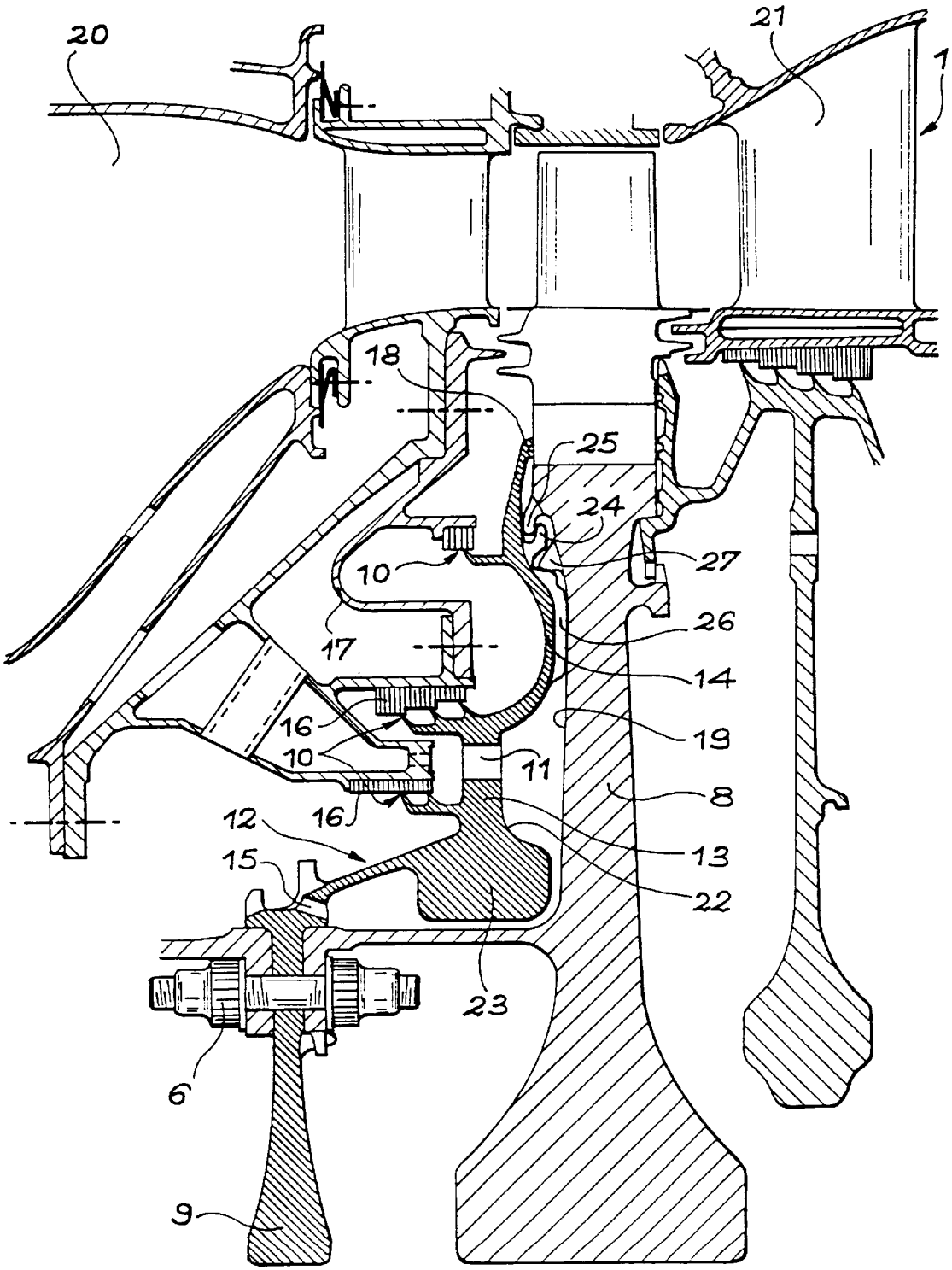
FIG. 2, a half-section of part of a turbojet in which the invention is installed.
Figure 4:
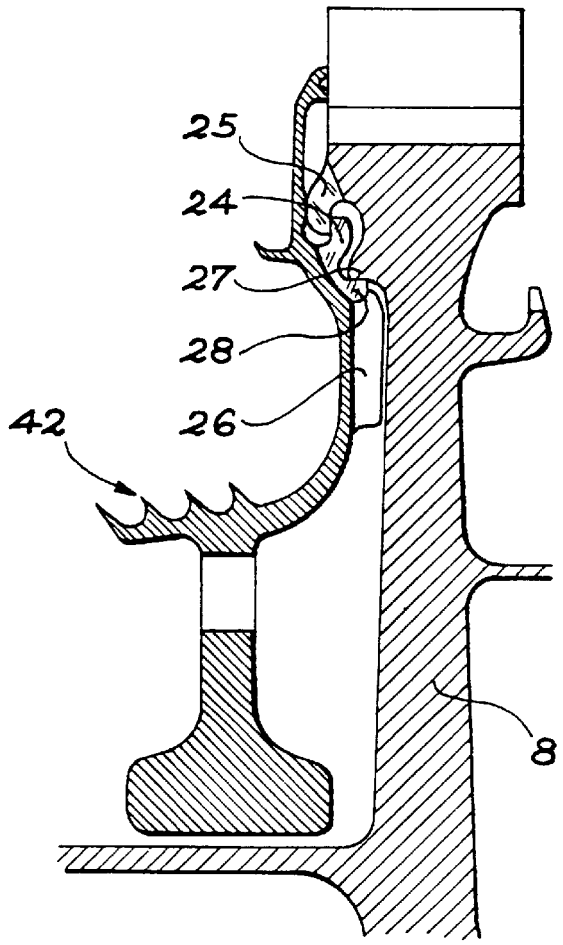
FIG. 4, a section of a second alternative of the labyrinth disk according to the invention.

The second alternative shown in FIG. 4 contains the same holes 30 in the main stiffener 33. However, the attachment system shown in FIG. 2 is the same. In other words, it uses the same set of attachment teeth 24 on the labyrinth disk 42 positioned to correspond with the attachment teeth 25 on the rotor disk 8 to form the bayonet system. Radial stops 28 are provided in the outer part of ribs 26 and are positioned to correspond with the stops 27 on the rotor disk 8.

Figure 5:
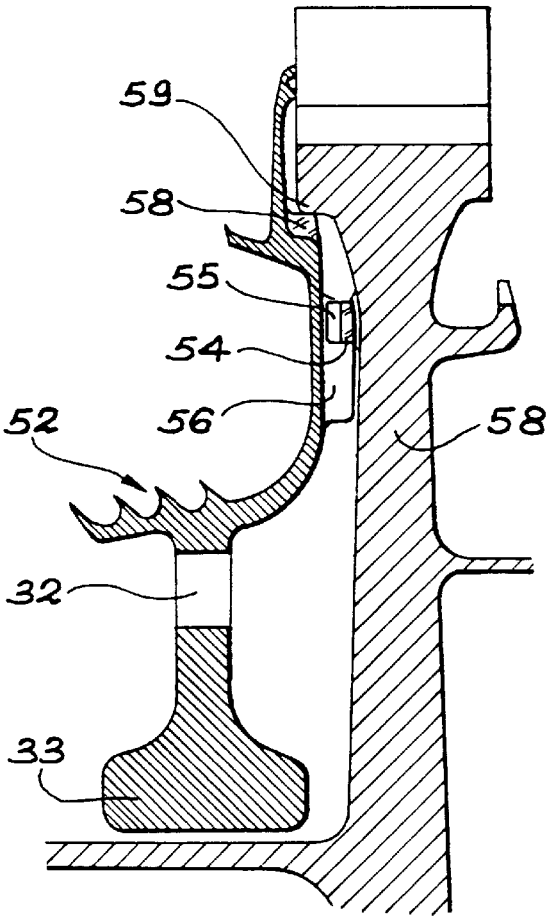
FIG. 5, a section of a third alternative of the labyrinth disk according to the invention.

FIG. 5 shows a third alternative still using the single main stiffener 33, elongated to allow for the use of holes 32 on each side of the stiffener disk 52. In this version, teeth 58 contact a stop 59 and the radial stops 58 are placed more towards the outside of the attachment system. They are placed facing the surfaces of the stops 59 of rotor disk 8. The axial attachment is made by means of a bayonet attachment system on ribs 56. They make use of teeth 54 that engage in the teeth in the bayonet locking system 55 corresponding to the rotor disk 8.

Figure 6:
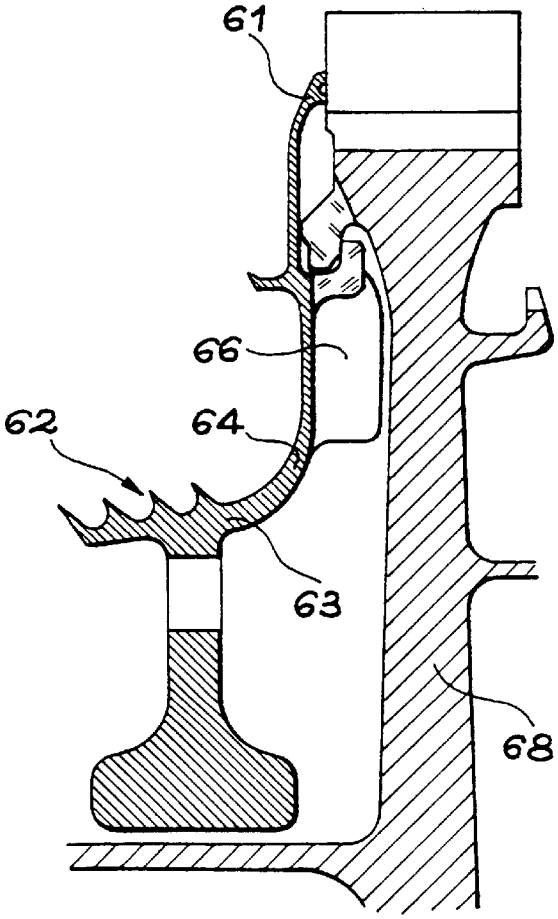
FIG. 6, a section of a fourth alternative of the labyrinth disk according to the invention.

The fourth alternative in FIG. 6 shows a different shape of the crown 64 of the labyrinth disk 62. Indeed, from its outer end 61, this crown is almost straight, i.e. its downstream surface 63 is further away from the rotor disk 68 than in the other embodiments. Consequently, the ribs 66 are wider.

Figure 7:
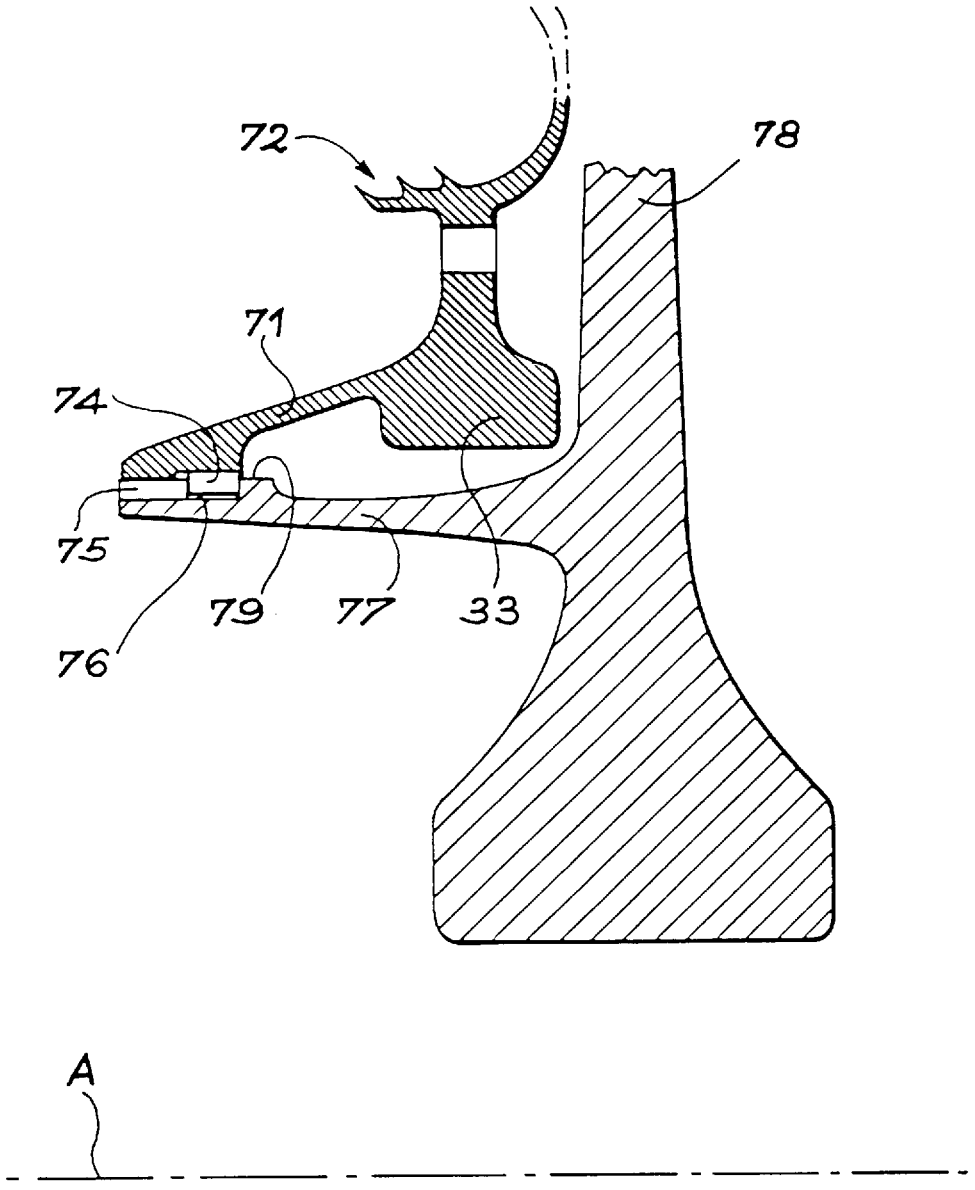
FIG. 7, a section showing an alternative method of attaching the labyrinth disk according to the invention.

The number of alternatives may also be increased by changing the labyrinth disk attachment means on the rotor disk. With reference to FIG. 7, the attachment by bolting may be eliminated to be replaced by a bayonet type attachment. In this case, there is an axial ring 71 on the inside and upstream from the main stiffener 33; a sectional view through this axial ring shows that it is in the shape of a foot, as shown in FIG. 7. Similarly, the rotor disk 78 also has an axial ring 77 that extends approximately parallel to the turbojet centerline A, to come into contact with the end of the axial ring 71 of the labyrinth disk 72.

Attachment means on the labyrinth disk 72 consist of a set of tenons 74 each penetrating into a rib 76 formed on the outer surface 79 of the axial ring 77 of the rotor disk 78. These tenons 74 may be inserted through longitudinal notches 75 machined on this outer surface 79 of the axial ring 77 of the rotor disk 78. Centering is done by direct contact of these two parts at the outer surface 79 of the axial ring 77 of the rotor disk 78.

All these embodiments make sizing of this assembly, which forms the labyrinth disk, easier at the design stage, and longer lives can be obtained.

The operating capacity of this type of part enables a much more severe thermomechanical environment due to the distribution of masses accumulating heat, and the ventilation system for this assembly which is formed by the labyrinth disk.

We claim:

1. A labyrinth disk for a turbomachine rotor having a rotor disk with a main stiffener, comprising:

a main rim, a labyrinth built into the rim, a crown placed in an outer extension of the rim supported on an upstream surface of the rotor disk, said crown comprising the upper part of the rim, being at least partially elongated in a radial direction and being at least partially convexly shaped, a downstream surface of said crown being located in substantially the same axial position as a downstream end of the main stiffener, and an attachment attaching the labyrinth onto the rotor disk, wherein said attachment comprises a radial main stiffener built into the rim.

2. A labyrinth disk according to claim 1, wherein the attachment comprises a lower part of the rim and includes attachment holes formed in said rim at a location upstream from the main stiffener, and a plurality attachment of bolts respectively fitted in the attachment holes.

3. A labyrinth disk according to claim 1, wherein the attachment includes a bayonet locking system fixed on the rotor disk, said system having first attachment teeth and including second attachment teeth located on said labyrinth, said second attachment teeth being positioned respectively behind said first attachment teeth.

4. A labyrinth disk according to claim 3, which comprises a plurality of radial stops located on said labyrinth and a plurality of radial stops formed on the rotor on an upstream surface of the rotor, said radical stops on said rotor being respectively contacted by said radial stops on said labyrinth.

5. A labyrinth disk according to claim 1, wherein the crown comprises a plurality of ribs.

6. A labyrinth disk according to claim 4, wherein the crown comprises a plurality of ribs located along a lower extension line of the second attachment teeth.

7. A labyrinth disk according to claim 4, wherein an inside portion of the second attachment teeth forms an axial attachment member.

* * * * *